US007435024B2

(12) United States Patent
Mindler

(10) Patent No.: US 7,435,024 B2
(45) Date of Patent: Oct. 14, 2008

(54) ONE TIME USE PAPER EDGE CLEANER

(75) Inventor: Robert F. Mindler, Churchville, NY (US)

(73) Assignee: Eastman Kodak Company, Rochester, NY (US)

( * ) Notice: Subject to any disclaimer, the term of this patent is extended or adjusted under 35 U.S.C. 154(b) by 497 days.

(21) Appl. No.: 11/101,360

(22) Filed: Apr. 7, 2005

(65) Prior Publication Data

US 2006/0228154 A1 Oct. 12, 2006

(51) Int. Cl.
*B41J 29/12* (2006.01)
*B41J 29/17* (2006.01)

(52) U.S. Cl. ..... 400/613; 400/719

(58) Field of Classification Search ..... None
See application file for complete search history.

(56) References Cited

U.S. PATENT DOCUMENTS 1,912,388 A * 6/1933 Slovin ..... 206/416
3,756,392 A * 9/1973 Oehlmann ..... 229/5.5
3,803,817 A * 4/1974 Lewis ..... 55/498
4,235,335 A * 11/1980 Cosentino ..... 206/389
5,035,236 A * 7/1991 Kanegaonkar ..... 128/201.13

FOREIGN PATENT DOCUMENTS

KR 2002051944 A * 7/2002

* cited by examiner

*Primary Examiner*—Daniel J Colilla

(57) ABSTRACT

An article for collecting dust and debris from edges of paper rolls comprising an annular body of material having a plurality of undulations on the surface of the body to provide one plurality of ridges resiliently disposed in one direction and another plurality of ridges resiliently disposed in an opposite direction.

21 Claims, 6 Drawing Sheets

ONE TIME USE PAPER EDGE CLEANER

FIELD OF THE INVENTION

This invention relates in general to methods and apparatus for printing, and in particular, to a method and article for cleaning dust and debris from the edges of rolls of photographic quality print paper used in a thermal dye transfer printer.

BACKGROUND OF THE INVENTION

Digital photography is an increasingly popular form of photography. However, most photographers still want hard copies of their pictures for archival, sharing and display purposes. Conventional prints from photofinishers are far superior to most prints made from home based printers because many home based printers use conventional ink jet technology. Such conventional, ink jet printers are low cost devices and they provide printed images having a range of quality levels, some of which are unacceptable, others that fade quickly, and some that have good color and long life. Recently, thermal dye transfer printers have emerged as a consumer favorite for use in home printing of color digital images. Such printers create an image from sequential patches of different colors of donor material and apply a clear, protective coating to the finished print. These printers reproduce excellent images that are quite durable and generally superior to images made with conventional ink jet printers.

In a typical thermal dye transfer printer, a donor supply roller is on one side of the thermal printing head and it supplies a web of thermal dye transfer donor material. The donor web travels across a linear array of heat elements (heat line) that are selectively operated to transfer donor material from the donor web to a receiver web. The used donor web is wound on a donor take-up roller. The web of donor material may comprise a single color for monotone printing, but it preferably comprises at least three sequential sections of different colors in order to provide full-color print and a clear section for applying a protective cover on the print.

Beneath the print head is a cylindrical platen. The platen is coupled to a suitable drive such as a platen stepper motor by a suitable transmission such as a belt. High quality paper for receiving the dye transfer image is stored on a paper supply roll. The web of receiver paper is withdrawn from its supply roller and travels along a printing path that leads it between the platen and the donor web at the location of the print head. After transfer of the donor material, the receiver web is advanced by rollers toward a separating station where a knife separates sequential images from each other. Severed pieces of the receiver web with printed images are deposited in a discharge hopper.

Receiver supply rollers are normally manufactured in elongated rolls that are several feet or a meter in length or more. The long rolls are cut into smaller length rolls that fit into a typical kiosk thermal dye printing machine. The cutting action leaves a residue of unwanted particle of dust and debris that stick to the edge of the web as it is withdrawn from the roll. The sticking may be due to electrostatic, van der Waals, or other forces. Unless the particles are removed, they may jam the printer or fall onto the prints and reduce the quality of the image on the print.

In order to solve this problem, cleaners are typically placed along and against an edge of receiver supply rollers. The cleaners are typically made from a pliable synthetic foam material that bears gently against opposite edges of the receiver web to capture and remove dust and debris particles one the edge. Over time the cleaners accumulate more debris and dust than they can reliably hold. The cleaners must be periodically serviced and either cleaned or replaced with new cleaners. If printer operation and maintenance personnel ignore the recommended maintenance regimen, printer operation can be impaired so that it requires extensive cleaning or reconditioning. Unfortunately, this occurs with a certain degree of installed printers and is a source of manufacture warranty work that could be prevented by timely cleaning or replacement of the foam web cleaners. What is needed in the art is an automatic cleaning system for use with a thermal printer that does not itself require maintenance.

SUMMARY OF THE INVENTION

The invention provides one time use wipers for cleaning the edges of a roll of print paper installed in a printing apparatus such as a thermal dye transfer printer. In one aspect, the invention is an article for collecting dust and debris from edges of a roll of paper. In one embodiment, the wiper is an annular disk of resilient material such as paper. The disk has an inner diameter about the same size as the inner diameter of a paper roll and an outer diameter equal to or greater than the diameter of the paper roll. The paper disk version has two or more pairs of diametrically opposed creased ridges or other permanent deformations. A first set of ridges has apexes on one surface of the disk that bear against the end of a roll of paper and a second set of ridges has apexes on the other surface of the disk that bear against a flange that supports the roll of receiver paper. The paper leaves roll at a tangent to the roll and edges of the paper wipe against the ridges that face the ends of the roll. The disks are held in contact with the ends of the roll by the spring force generated by the resilient paper body of the disk and its opposing ridges. This is similar to the spring forces generated by a wavy or Bellville washer.

The material used for the wiper can be paper or any other material that is thin enough to fit between the ends of roll and the supporting flanges. The material should be pliable enough to form and retain ridges when the material is bent beyond its limit of elasticity. The material should also be elastic or resilient enough to generate the necessary forces for urging the apexes of the inner ridges against the end of the roll to wipe the edges of the roll as the web passes the ridges. The ridges can be creased, or not, as desired.

As an alternate embodiment, a wiper can be made from other materials or combinations of materials that achieve the similar results. Such other materials include and are not limited to plastic, felt, rubber and foam packaging materials of polyethylene and other natural and synthetic resilient material. Material shaped into an annular disk that is folded to provide opposing surface creased ridges is one elegant and inexpensive embodiment. Other structures could dispense with creased ridges and instead form wipers with ridges that are themselves resilient and attached to the surface of a supporting disk, or form a disk from material with ridges that are molded into the material of the disk.

In the one material embodiment, the wiper is placed at each end of a cylindrical roll of print paper, web or other web material that is dispensed by unrolling the web from the cylinder. Each wiper is aligned normal to the axis of the cylinder, and touches the web edge at a number of points sufficient to insure the edge of the web roll makes contact with one or more of the ridges as the web unrolls. The ridges of the wiper rub against the edges of the unrolling web, thereby engaging and removing any edge dust and debris during the unrolling process.

Each wiper is held by friction between one end of the rolled web and a corresponding flange that supports the roll for rotation as the receiver roller turns and its web unrolls. An edge of the receiver web thus moves across the raised creases of the wiper. While the receiver web edge is between the surface of the rolled web and the outer periphery of the wiper, the edge of the receiver web rubs against a ridge of the wiper, allowing the wiper to engage and remove dust and debris from the web edge. In all embodiments, the radius of the wiper is sufficiently larger than the maximum radius of the roll of web in order to provide adequate cleaning contact to the outermost windings of the web on the roll.

These and other embodiments will be understood by those skilled in the art and are shown and described in the following detailed description, the accompanying drawing and the appended claims.

DETAILED DESCRIPTION OF THE INVENTION

Figure 5:
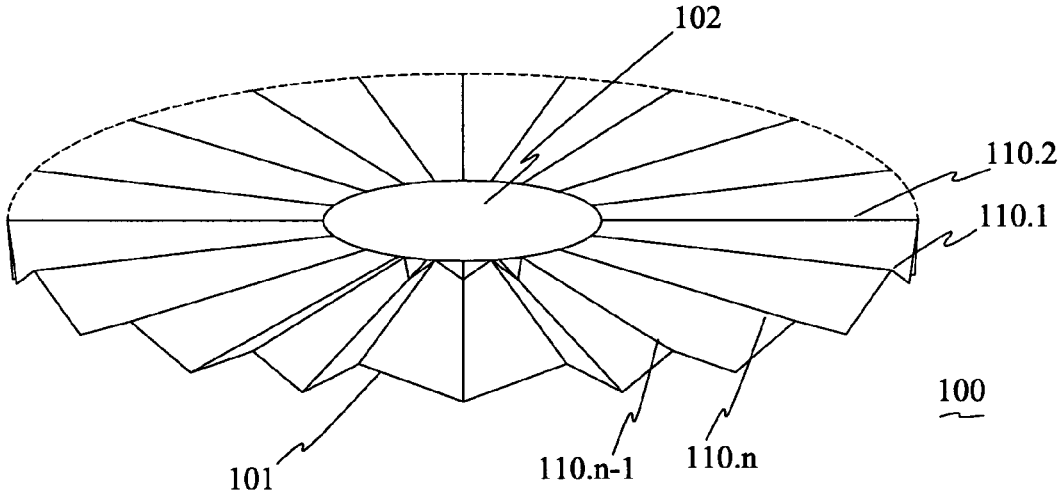
FIG. 5 shows one embodiment of a wiper.

Wiper 100 has an annular shape with an outer diameter 101 and an inner diameter 102. The inner diameter 102 is large enough to allow passage of the boss of a flange. The paper material has a number of raised ridges 110.1, 110.2, . . . **110.*n*-1, 110.*n*, each shown in FIG. 5 as having an optional crease. An exemplary wiper 100 is shown in FIG. 5. Wiper 100** is typically made of paper that is preferably stiff enough to hold a ridge.

Figure 1:
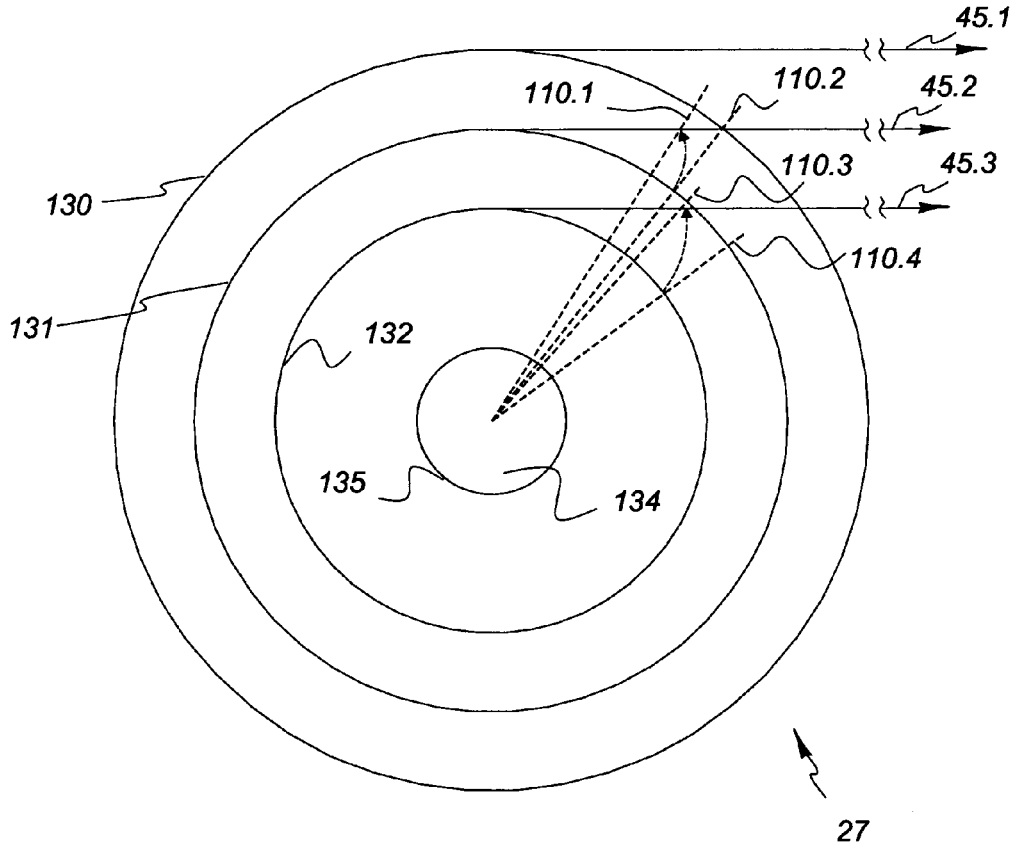
FIG. 1 shows a several views of the receiver web at different diameters.
Figure 2:
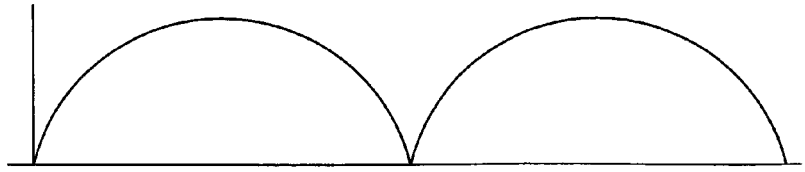
FIG. 2 shows the effective path of a point on the edge of the receiver web with respect to wiper ridges on the wiper.

In FIG. 1 there is shown an end view of roller 27 of a receiver web 45. Roller 27 has receiver web 45 wound on a cylinder 135 with an opening 134 along the length of its axis. When roller 27 is first installed in a printer, it has the initial diameter 130. Receiver web 45 is drawn off roller 27 in an initial draw, shown as 45.1. In FIG. 1, the relative position of selected ridges 110.1-110.4 appear as dotted radial lines. FIG. 1 also shows roller 27 at two later times after substantial portions of receiver web 45 have been withdrawn. At such times roller 27 has a second, smaller diameter 131 and a third, still smaller diameter 132. Receiver web 45 is tangential to roller 27 as portions of the receiver material web are withdrawn and the relative locations of receiver web 45 for the diameters are shown at 45.2 and 45.3, respectively. When one uses a ridge, such as ridge 110.1, as a reference, the path of an edge of receiver web 45 across ridge 110.1 describes a curved (cycloid) path across the surface of the ridges of wiper 100 (dotted arrows). To clean the edges of receiver web 45, it would be ideal if every edge point made contact with a ridge of wiper 100 over some substantial arc of that cycloid. FIG. 2 shows a cycloid in full (two revolutions). The contact range of a radial contact ridge 110 increases as the radius of unwinding roller 27 decreases (compare the length of the two arrows in FIG. 1, and the arc subtended by each arrow).

Figure 3:
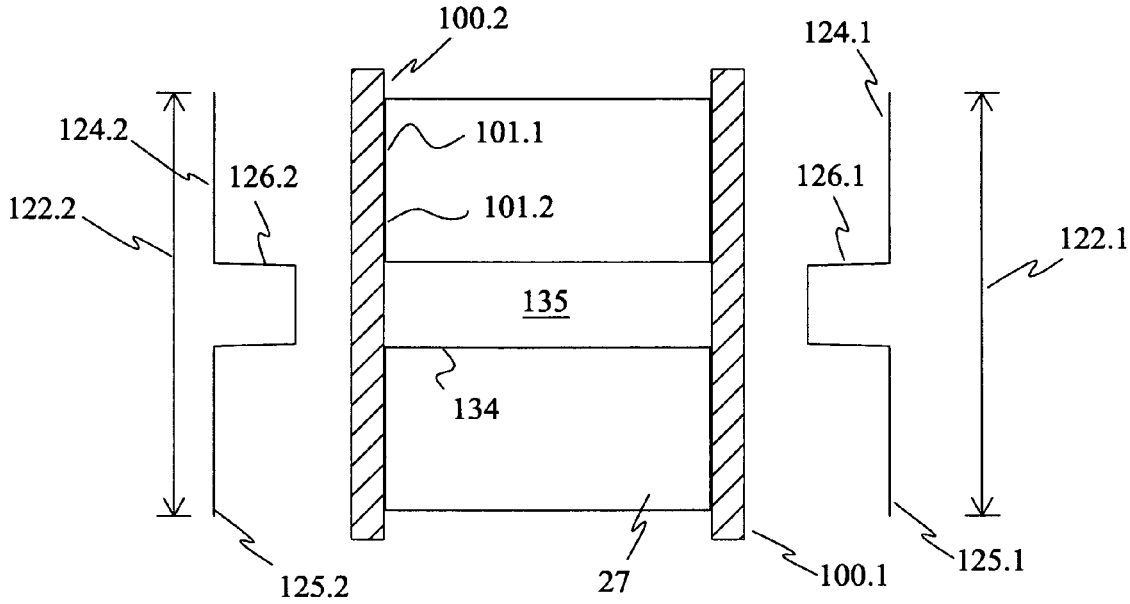
FIG. 3 shows a schematic diagram of flanges positioned outside the receiver web with wipers on opposite sides.
Figure 4:
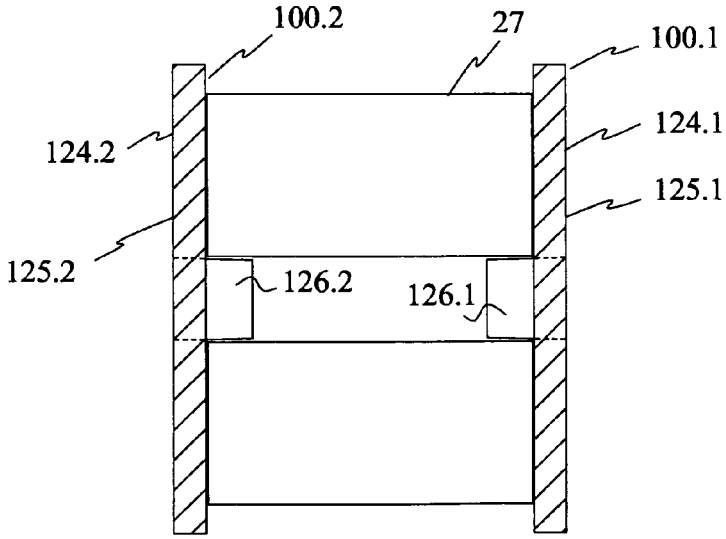
FIG. 4 shows a schematic view of the flanges positioned to support the receiver web for rotation.

In a typical printer, receiver web 45 is on a roller 27 that is supported on opposite ends by flanges. For example, in the embodiment of FIG. 3, two flanges 125.1 and 125.2 are disposed on opposite ends of roller 27. Flanges 125.1 and 125.2 have annular rims 124.1, 124.2 that extend from axial bosses 126.1, 126.2, respectively. The outside diameters 122.1, 122.2 of rims 124.1 and 124.2 is preferably the same diameter or greater than the outside diameter of roller 27. The outside diameter of wipers 100.1 and 100.2 is also equal to or greater than the outside diameter of roller 27. Wipers 100.1 and 100.2 are positioned adjacent the opposite ends of receiver web 45 and between flanges 125.1 and 125.2 and ends of roller 27. Bosses 126.1, 126.2 are tapered to limit the penetration of the bosses into axial opening 134 of the web support cylinder 135. FIG. 4 shows wipers 100.1, 100.2, respectively, between flanges 125.1, 125.2, respectively and roller 27 of receiver web 45.

Figure 6:
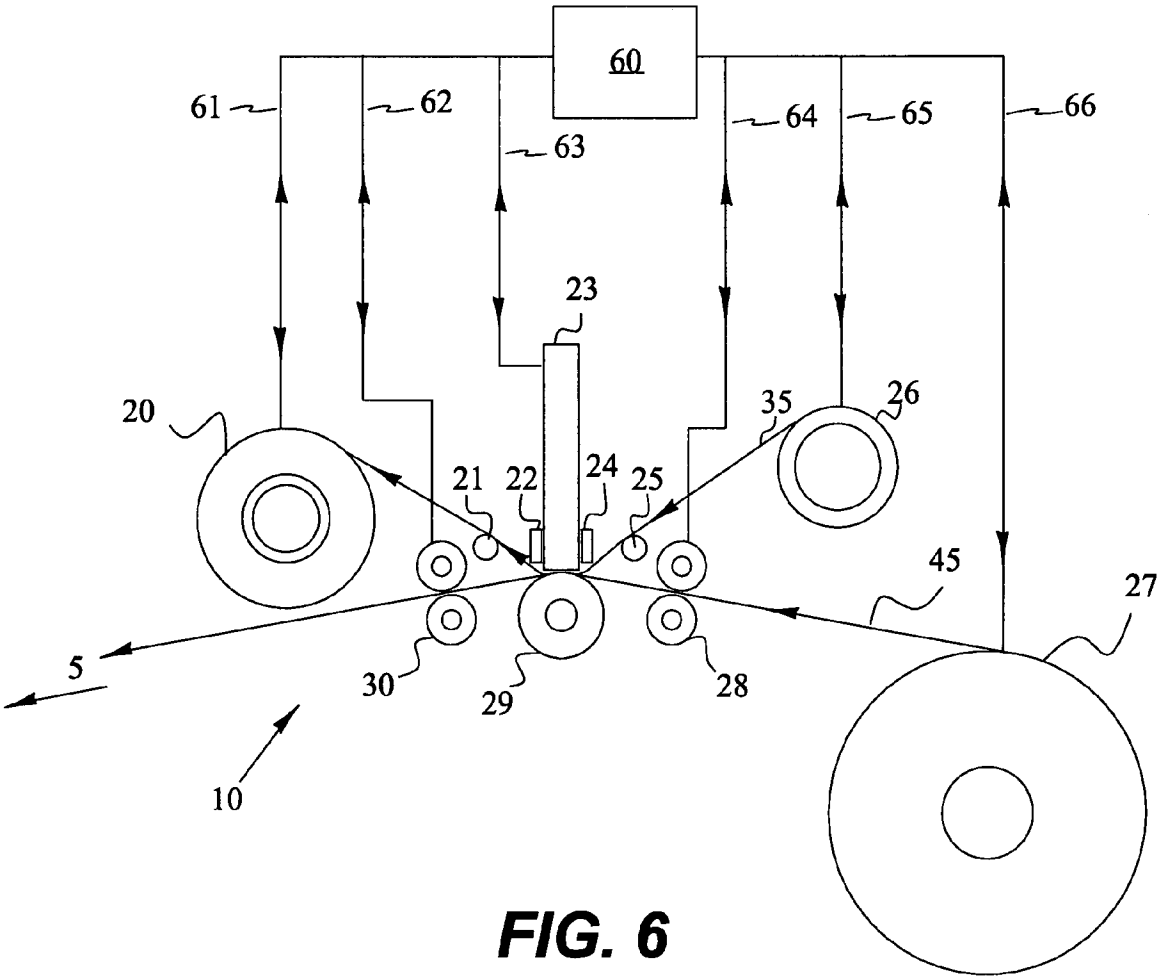
FIG. 6 shows a schematic representation of a printer with a web of receiver sheet on a supply roller.

Turning to FIG. 6, there is shown a schematic of a thermal printer 10 that may benefit from the invention. Printer 10 has a donor supply roller 26 that supports a donor web 35 of thermal transfer donor material. Donor web 35 extends along a path that includes the donor supply roller 26, a first idler roller 25, a first stripping plate 24, thermal print head 23, a second stripping plate 22, a second idler roller 21 and donor take-up roller 20.

Roller 27 of receiver web 45 is located in printer 10. The view in FIG. 6 omits flanges and wipers so that the operation of printer 10 may be explained. Receiver web 45 can be any suitable material, cloth or paper including but not limited to special paper for receiving thermal dye transfer images of digital photographs. Receiver web 45 travels back and forth along a paper path 5 that includes a pair of forward drive rollers 30, a freely rotating support platen roller 29, and a pair of reverse drive rollers 28. Print head 23 engages the donor and receiver webs 35, 45, friction between the two webs is strong enough for the drive rollers 30, 28 to move the two webs together past the print head 23. Drive rollers 30 have relatively powerful motors or gear trains that provide high enough torque to move the webs 35, 45. In contrast, torque applied to supply and take-up rollers 26, 20 is just enough to prevent slack in donor web 35. In operation, forward drive rollers 30 pull donor and receiver webs 35, 45 from right to left and drive rollers 28 pull donor and receiver webs 35, 45 in the opposite direction. Donor web 35 passes over and contacts print head 23. Receiver web 45 is disposed between donor web 35 and a free turning platen roller 29. Rollers 20, 26 and 27 have suitable drive motors (not shown) and/or drive trains for turning rollers 20, 26, 27 in clockwise or counterclockwise directions to accommodate driving donor and receiver webs 35, 45 in forward and reverse directions.

Printer 10 has suitable circuits, sensors, integrated circuits, processors, memory, operating and application software, for operating and controlling printer 10 and the individual components thereof. In particular, a controller 60 raises and lowers print head 23, selectively operates the heater elements in the print head 23 that transfer donor material from donor web 35 to receiver web 45, operates drive rollers 28, 30 to move receiver web 45 in the forward (right to left) and reverse (left to right) directions, operates the supply and take-up rollers 26, 20 to move donor web 35 in forward or reverse directions. Controller 60 has lines 61 and 65 that that connect controller 60 with sensors and actuators at the supply and take-up rollers 26, 20. Other lines 62, 64 connect controller 60 to actuators (not shown) for drive rollers 30, 28. Line 63 connects controller 60 to print head 23 and carries signals for actuators (not shown) that raise and lower print head 23 and also selectively operate the heating elements in print head 23. Another line 66 connects controller 60 to an actuator (not shown) for receiver web roller 27.

Those skilled in the art understand that the schematic of FIG. 6 omits details of the controls for operating printer 10. However, these controls are generally conventional and may be found in other machines and are otherwise well-known to those skilled in the art. Likewise, this description omits the motors, solenoids and other actuators, sensors and encoders that are used for turning and driving supply and take-up rollers 26, 20, drive rollers 30, 28 and receiver roller 27. Again, those items are well-known to those skilled in the art. Also known to those skilled in the art are suitable electronics for actuating the heater elements in a linear array of a thermal print head. Those skilled in the art further understand that thermal print head 23 and platen roller 29 are kept in close engagement during printing. A linear actuator (not shown) moves print head 23 relative to platen roller 29 in order to permit donor web 35 to index from one color section to another.

In operation, receiver web 45 is withdrawn from roller 27. Roller 27, its wipers 100.1, 100.2 and its flanges 125.1, 125.2 turn together. However, as receiver web 45 separates from roller 27, the edges of receiver web 45 wipe against the raised ridges **110.1-110.*n* of wipers 100.1, 100.2. The raised ridges remove dust, debris and other spurious materials from the edges of receiver web 45. When all of receiver web 45 on roller 27 is expended, it is removed from printer 10, and flanges 125.1, 125.2 are separated, and roller 27 and wipers 100.1, 100.2 are discarded. A fresh roller 27 is selected. In the one embodiment, each roller 27 is packaged together with a pair of fresh wipers 100.1, 100.2. The operator is thus encouraged by the common packaging of wipers 100.1, 100.2 and roller 27 to install new wipers 100.1, 100.2 with each new roller 27**. This provides fresh, clean wipers for each new roll.

The above embodiment disclosed that wipers 100.1 and 100.2 that are made from inexpensive paper material that has raised radial contact ridges in the cleaning material to make effective contact with the edges of receiver web 45. As should be made clear from FIG. 1, this constraint requires either that wipers 100.1 and 100.2 make effective contact with the edge at all points on its surface, or that the wipers 100.1 and 100.2 make effective contact with an edge of receiver web 45 at a sufficient number of points to ensure that many or all points on receiver web 45 are effectively cleaned. The interval between radial contact ridges must be kept small enough to insure complete cleaning.

Those skilled in the art understand that other embodiments of the invention are possible. For example, in a very simple form, a simple annular disk of paper could be folded in half and then into quarters to provide a minimal set of creased ridges. Other embodiments include annular disks made of synthetic, resilient material with ridges of the same or different material embedded into the faces of the annular disks. Such embodiments would use material with an elastic consistency to ensure uniform surface contact at all points of the web edge. Those skilled in the art also understand that annular wipers or disks may be made of any suitable material including and not limited to paper, plastic, felt, rubber and foam packaging materials of polyethylene and other natural and synthetic resilient material.

In addition, the invention is not limited to annular disks with circular outer diameters. Embodiments of the invention may be fashioned from paper with any outer border, including and not limited to square or rectangular outer borders. The outer border may be any border configuration including and not limited to regular and irregular or amorphous shapes, circular, and regular polygon and irregular polygon. Two further examples are show.

Figure 7A:
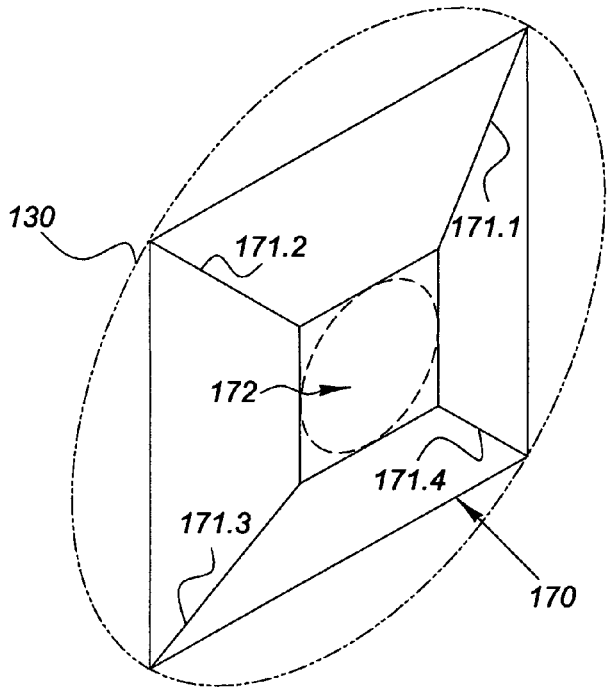
FIGS. 7A-7D show alternate embodiments with four outer edges.
Figure 7B:
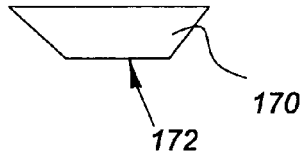
Figure 7C:
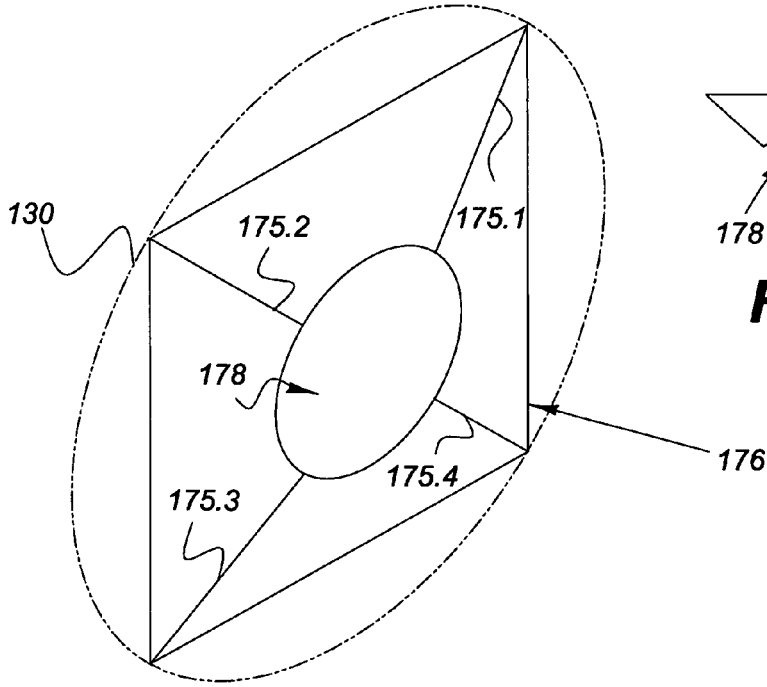
Figure 7D:
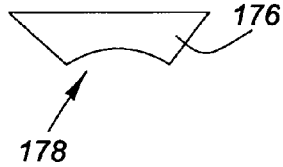

The first further example is a regular polygon in the shape of a square. See FIGS. 7A and 7B. Wiper 170 is shown against the phantom view of first receiver diameter 130 of the outer diameter of the receiver roller. There are four, optionally creased, ridges 171.1-171.4. Note also the quadrilateral opening 172. When the wiper 170 is folded across two diagonally opposite creased ridges 171.1, 171.3, it has a trapezoidal profile as seen in FIG. 7B. Another four-sided embodiment is shown in FIG. 7C. There the wiper 176 has four creased ridges 175.1-175.4 and a circular opening 178. It profile (FIG. 7D) is quasi-trapezoidal with an arch-like apex 178 that becomes a circular opening when placed against the side of the receiver roller 27. As such, the annular body of the invention may have outer and inner borders that are circular or defined by a polygon of regular or irregular edges or by combinations of circular and polygon edges. In particular, and as shown in FIGS. 7A-7D, the invention may have a quadrilateral outer and inner borders or a quadrilateral outer border and a circular inner border. The quadrilateral may be in the shape of a rectangle or square.

Figure 8A:
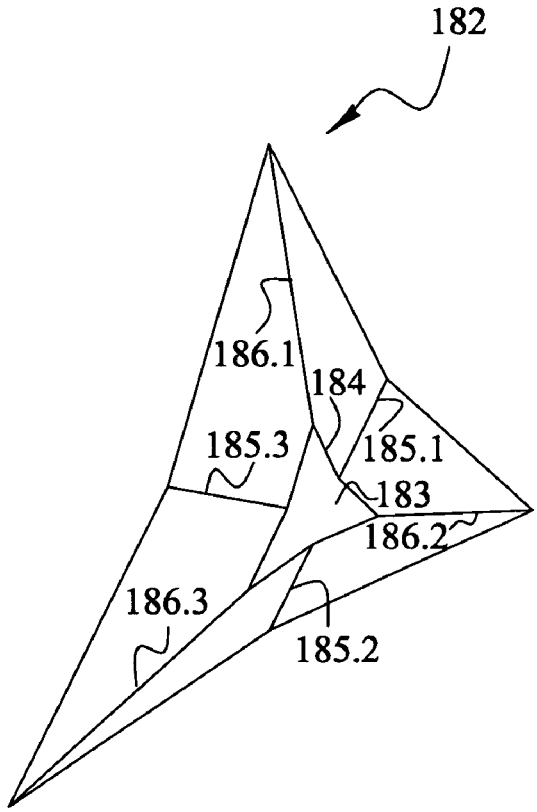
FIGS. 8A-8B show another embodiment with three outer edges.
Figure 8B:
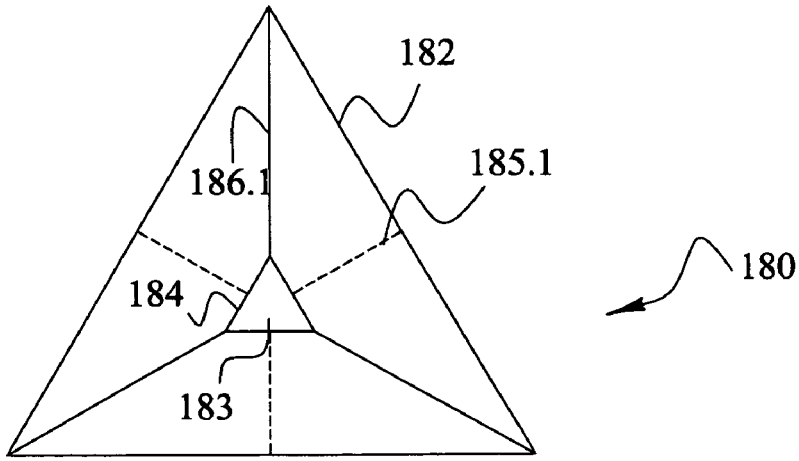

A second further example is a regular polygon with three sides. See FIGS. 8A and 8B. They show a three sided wiper 180. It has a three sided outer border 182 and an inner opening 183 also defined by a three sided inner border 184. First outside ridges 186.1, 186.2 and 186.3 are optionally creased and extend from inner border 182 to the apexes of the outer border. Second inside ridges 185.1, 185.2 and 185.3 are also shown as being optionally creased and extend from about the midpoints of the outer and inner sides.

Thus a wiper may have any suitable outer border shape and any suitable inner border shape. If made of paper or other deformable and resilient material, the material is permanently creased into wiper ridges. The wiper ridges bear against the ends of the receiver roller. The wiper may be self-biasing by providing creases on both sides in a manner similar to wavy or Bellville washers. The creased ridges provide the bias and the wiping edge that removes dust and debris from the edges of the receiver roller.

The invention has been described in detail with particular reference to certain preferred embodiments thereof, but it will be understood that variations and modifications can be effected within the spirit and scope of the invention.

PARTS LIST 5 paper path
10 printer
20 donor take up roller
21 idler roller
22 strip plate
23 thermal print head
24 strip plate
25 idler roller
26 donor supply roller
27 receiver roller
28 drive roller
29 platen roller
30 drive roller
35 donor web
45 receiver web
45.1 first tangent
45.2 second tangent
45.3 third tangent
60 controller 61 control line
62 control line
63 control line
64 control line
65 control line
66 control line
100 wiper
100.1, 100.2 wiper
101 o. d. wiper
101.1, 101.2 o. d. wiper
102 i. d. wiper
110 ridges
110.1, 110.2 ridges
110.n, 110.n-1 ridges
122.1, 122.2 o. d. flange
124.1, 124.2 rim
125.1, 125.2 flange
126.1, 126.2 boss
130 first receiver diameter
131 second receiver diameter
132 third receiver diameter
134 opening
135 support cylinder
170 four-sided wiper
171.1 creased ridge
171.2 creased ridge
171.3 creased ridge
171.4 creased ridge
172 opening
175.1 creased ridge
175.2 creased ridge
175.3 creased ridge
175.4 creased ridge
176 four-sided wiper
178 opening
180 three-sided wiper
182 outer border
183 inner opening
184 inner border
185.1 inside ridge
185.2 inside ridge
185.3 inside ridge
186.1 outside ridge
186.2 outside ridge
186.3 outside ridge

The invention claimed is:

1. In a printer for printing text or images or both on receiver sheets fed from a roll of receiver paper supported in the printer by a pair of opposing flanges, a method for collecting dust and debris from respective edges of the roll of paper comprising:

providing annular bodies of disposable material, each having a first plurality of ridges forming a first plurality of apexes in a first direction and a second plurality of ridges forming a second plurality of apexes in a second, opposite direction; and placing one annular body on one flange and another annular body on the other flange so that the first plurality of apexes on the annular bodies are biased against respective edges of the roll of paper and the other plurality of apexes on the annular bodies are biased against respective flanges for scraping dirt and debris from the edges of the roll of paper.

2. The method of claim 1, wherein the annular bodies are made of thin, pliable material that retains the ridges when the material is bent beyond a limit of elasticity.

3. The method of clalm 1, wherein the material of the annular bodies comprises one or a combination of materials selected from the group consisting of paper, plastic, felt, rubber and foam packaging materials of polyethylene and other natural and synthetic resilient material.

4. The method of claim 1, wherein the material of the annular bodies is folded across one or more diameters of the annular body of the article to provide at least one pair of creased ridges extending in opposite directions from opposite sides of the body.

5. The method of claim 1, wherein the material of the annular bodies is folded in a first direction across one or more diameters of the annular body of the article to provide at least one pair of creased ridges extending in the same direction to bear against the edge of the roll of paper.

6. The method of claim 5, wherein the material of the annular bodies is folded across another diameter in a second, opposite direction across one or more diameters of the annular bodies of the article to provide at least one pair of creased ridges extending in the same direction to bear against a flange that supports the roll of paper.

7. The method of claim 1, wherein the annular bodies each comprises a circular or polygon body with a central opening.

8. The method of claim 1, wherein the annular bodies each comprise a circular or polygon opening.

9. The method of claim 8, wherein the annular bodies outside border with three or more edges and defining the opening has three or more edges.

10. The method of claim 1, wherein the annular bodies each have an outside border with three or more edges and an inner border with defining a circular opening.

11. A printer for printing text or images or both on receiver sheets that are fed from a roll of receiver paper supported in the printer at opposite ends of the roll of paper by respective flanges, said printer comprising:

first and second annular bodies, each annular body comprising a material having a first plurality of ridges forming a first plurality of apexes in a first direction and a second plurality of ridges forming a second plurality of apexes in a second, opposite direction, said first and second annular bodies disposed between respective ends of the roll of paper and the flanges, each annular body having its first plurality of apexes biased against one edge of the roll of paper and its second plurality of apexes are biased against one flange for scraping dirt and debris from the edges of the roll of paper.

12. The printer of claim 11, wherein the annular bodies are made of thin, pliable material that retains the ridges when the material is bent beyond a limit of elasticity.

13. The printer of claim 11, wherein the material of the annular bodies comprise one or a combination of materials selected from the group consisting of paper, plastic, felt, rubber and foam packaging materials of polyethylene and other natural and synthetic resilient material.

14. The printer of claim 11, wherein the material of the annular bodies is folded across one or more diameters of the annular body of the body to provide at least one pair of creased ridges extending in opposite directions from opposite sides of the bodies.

15. The printer of claim 11, wherein the material of the annular bodies is folded in a first direction across one or more diameters of the annular bodies of the body to provide at least one pair of creased ridges extending in the same direction to bear against the edge of the roll of paper.

16. The printer of claim 15, wherein the material of the annular bodies is folded across another diameter in a second, opposite direction across one or more diameters of the annular bodies to provide at least one pair of creased ridges extending in the same direction to bear against a flange that supports the roll of paper.

17. The printer of claim 11, wherein the annular bodies each comprise a circular or polygon body with a central opening.

18. The printer of claim 11, wherein the annular bodies each comprise a circular or polygon opening.

19. The printer of claim 18, wherein the annular bodies each have an outside border with three or more edges and an inner border defining the opening has three or more edges.

20. The printer of claim 11, wherein the annular bodies each have an outside border with three or more edges and an inner border defining a circular opening.

21. A method for collecting dust and debris from one edge of a paper roll, said method comprising:

providing an annular body of material having a plurality of undulations on the surface of the body to provide one plurality of ridges resiliently disposed in one direction and another plurality of ridges resiliently disposed in an opposite direction, and fitting the annular body between a supporting device for supporting the paper roll and one edge of the paper roll so that one plurality of ridges are biased against the edge of the paper roll and another plurality of ridges are biased against the supporting device for scraping dirt and debris from the edge of the paper roll.

* * * * *

UNITED STATES PATENT AND TRADEMARK OFFICE

CERTIFICATE OF CORRECTION

PATENT NO. : 7,435,024 B2
APPLICATION NO. : 11/101360
DATED : October 14, 2008
INVENTOR(S) : Robert F. Mindler It is certified that error appears in the above-identified patent and that said Letters Patent is hereby corrected as shown below:

Claim 3, Col. 7, line 66 delete “clalm” and insert --claim--

Signed and Sealed this

Thirty-first Day of March, 2009

John Doll

JOHN DOLL
*Acting Director of the United States Patent and Trademark Office*